US008098267B2

(12) United States Patent
Nomura

(10) Patent No.: US 8,098,267 B2
(45) Date of Patent: Jan. 17, 2012

(54) THERMAL PRINTER APPARATUS AND PRINTING METHOD

(75) Inventor: Takayuki Nomura, Chiba (JP)

(73) Assignee: Seiko Instruments Inc. (JP)

( * ) Notice: Subject to any disclaimer, the term of this patent is extended or adjusted under 35 U.S.C. 154(b) by 272 days.

(21) Appl. No.: 12/587,344

(22) Filed: Oct. 6, 2009

(65) Prior Publication Data

US 2010/0085409 A1 Apr. 8, 2010

(30) Foreign Application Priority Data

Oct. 7, 2008 (JP) ..... 2008-260341

(51) Int. Cl.
*B41J 2/00* (2006.01)

(52) U.S. Cl. ..... 347/196

(58) Field of Classification Search ..... 347/196, 347/195, 191, 190, 188, 183; 400/120.09, 400/120.1, 120.14, 120.15
See application file for complete search history.

(56) References Cited

U.S. PATENT DOCUMENTS 5,109,235 A * 4/1992 Sasaki ..... 347/183
5,255,011 A * 10/1993 Minowa et al. ..... 347/196
5,633,670 A 5/1997 Kwak ..... 347/188
5,800,075 A 9/1998 Katsuma et al. ..... 400/120
5,808,653 A * 9/1998 Matsumoto et al. ..... 347/188
5,841,461 A 11/1998 Katsuma ..... 347/195
2005/0134675 A1 6/2005 Higashiyama ..... 347/221

* cited by examiner

*Primary Examiner* — Kristal Feggins
(74) *Attorney, Agent, or Firm* — Adams & Wilks

(57) ABSTRACT

To provide a thermal printer apparatus and a printing method that can be adapted to different types of thermal paper having different thermal conductivity characteristics, a dot data memory 3 stores dot data for each line in synchronization with line sequential printing and delivers an energizing pulse selectively to a line thermal head 1 via a driving circuit 2. A multiplier 4 counts the number of dots to be printed for each line and multiplies a result of the counting by a heated thermal paper coefficient P1 corresponding to a thermal conductivity characteristic of a thermal paper 42. A heat accumulation counter 5 counts results of the multiplying in an accumulative manner. A multiplier 6 multiplies a count value in the heat accumulation counter 5 by a heat radiation coefficient and a heat radiation thermal paper coefficient P2 corresponding to the thermal conductivity characteristic of the thermal paper 42 repeatedly at a predetermined period, so as to correct and update the count value in the heat accumulation counter 5. An arithmetic unit 7 calculates an energizing pulse width based on the corrected and updated count value in the heat accumulation counter 5 in synchronization with line sequential printing, and controls the driving circuit 2 based on a result of the calculating.

5 Claims, 5 Drawing Sheets

THERMAL PRINTER APPARATUS AND PRINTING METHOD

BACKGROUND OF THE INVENTION

1. Field of the Invention

The present invention relates to a thermal printer apparatus and a printing method for printing in accordance with a thermal conductivity characteristic of thermal paper.

2. Description of the Related Art

It is known that when a thermal printer apparatus performs printing continuously, heat applied to a thermal head on printing is accumulated in the same so that temperature of the thermal head increases. When measuring such a temperature increase by using a temperature sensor, a temperature increase that changes in accordance with the number of printed dots cannot be detected because responsiveness of a temperature sensor for a general use is low. Therefore, there is proposed a technique of predicting a temperature increase of a thermal head by modeling temperature increase characteristics of the thermal head so as to detect the temperature increase in a pseudo manner (see, for example, Patent Document. JP 03-266659 A). Even if fast printing is performed, it is possible to control a quantity of heat to be applied by using the technique considering a temperature increase in the thermal head.

However, according to the technique described in Patent Document JP 03-266659A, as to the temperature increase in the thermal head upon printing, a temperature change is predicted by regarding the number of dots to be printed as a variable and by using a model in which the temperature increase changes in accordance with the number of dots. In addition, heat radiation of the thermal head when not working for printing is predicted by using a model of primary response characteristics due to a time constant determined by a heat radiation constant that is determined in advance. According to the predictions using the models, there is a problem in that if a type or a thickness of the thermal paper changes, a discrepancy occurs in a relationship between the temperature increase characteristics predicted by using a model and an actual temperature increase in the thermal head, which causes deterioration in print quality.

SUMMARY OF THE INVENTION

The present invention has been made to solve the problem described above, and an object thereof is to provide a thermal printer apparatus and a printing method that can be adapted to different types of thermal paper having different thermal conductivity characteristics.

In order to solve the above-mentioned problem, according to the present invention, a thermal printer apparatus comprises: a line thermal head for printing in a line sequential manner for each line in response to an energizing pulse corresponding to dot data containing information indicating whether or not there is a dot to be printed correspondingly to a print position; a driving circuit for supplying the energizing pulse selectively to the line thermal head in accordance with the dot data; a dot data memory for storing the dot data for each line in synchronization with line sequential printing and for delivering the dot data to the driving circuit; a first multiplier for counting a number of dots to be printed for each line, which is indicated by the dot data, and for multiplying a result of the counting by a first correction coefficient corresponding to a thermal conductivity characteristic of thermal paper; a heat accumulation counter for counting results of the multiplying the number of dots to be printed for each line, which is indicated by the dot data, by the first correction coefficient in an accumulative manner; a second multiplier for multiplying a count value in the heat accumulation counter by a second correction coefficient corresponding to the thermal conductivity characteristic of the thermal paper and a heat radiation coefficient repeatedly at a predetermined period, so as to correct and update the count value; and an arithmetic unit for calculating an energizing pulse width based on the corrected and updated count value in the heat accumulation counter in synchronization with the line sequential printing and for controlling the driving circuit based on a result of the calculating.

Further, according to the present invention, in the invention described above, the first correction coefficient is set to be a value smaller than one if heat accumulated in the line thermal head is less than a preset predetermined value due to the thermal conductivity characteristic of the thermal paper, and the first correction coefficient is set to be a value larger than one if the heat accumulated in the line thermal head is more than the preset predetermined value.

Further, according to the present invention, in the invention described above, the second correction coefficient is set to be a value smaller than one if a heat radiation characteristic of the line thermal head is higher than a preset predetermined value due to the thermal conductivity characteristic of the thermal paper, and the second correction coefficient is set to be a value larger than one if the heat radiation characteristic is lower than the preset predetermined value.

Further, according to the present invention, a printing method for a thermal printer apparatus comprises the steps of: printing by a line thermal head in a line sequential manner for each line in response to an energizing pulse corresponding to dot data containing information indicating whether or not there is a dot to be printed correspondingly to a print position; supplying the energizing pulse selectively to the line thermal head in accordance with the dot data by a driving circuit; storing the dot data for each line in synchronization with line sequential printing and delivering the dot data to the driving circuit by a dot data memory; counting a number of dots to be printed for each line, which is indicated by the dot data, and multiplying a result of the counting by a first correction coefficient corresponding to a thermal conductivity characteristic of thermal paper by a first multiplier; counting results of the multiplying the number of dots to be printed for each line, which is indicated by the dot data, by the first correction coefficient in an accumulative manner by a heat accumulation counter; multiplying a count value in the heat accumulation counter by a second correction coefficient corresponding to the thermal conductivity characteristic of the thermal paper and a heat radiation coefficient repeatedly at a predetermined period, so as to correct and update the count value, by a second multiplier; and calculating an energizing pulse width based on the corrected and updated count value in the heat accumulation counter in synchronization with the line sequential printing and controlling the driving circuit based on a result of the calculating by an arithmetic unit.

According to the present invention, in order to solve the problem described above, in the thermal printer apparatus, the dot data memory stores the dot data containing the information indicating whether or not there is a dot to be printed correspondingly to a print position on each line in synchronization with line sequential printing, and the dot data is delivered to the driving circuit. The driving circuit supplies an energizing pulse to the line thermal head selectively in accordance with the dot data. The line thermal head prints in a line sequential manner for each line in response to the energizing pulse. The first multiplier counts the number of dots to be printed for each line, which is indicated by the dot data, and multiplies the result of the counting by the first correction coefficient corresponding to the thermal conductivity characteristic of the thermal paper. The heat accumulation counter counts the results of the multiplying the number of dots to be printed for each line, which is indicated by the dot data, by the first correction coefficient in an accumulative manner. The second multiplier multiplies the count value in the heat accumulation counter by the second correction coefficient corresponding to the thermal conductivity characteristic of the thermal paper and the heat radiation coefficient repeatedly at a predetermined period, so as to correct and update the count value. The arithmetic unit calculates an energizing pulse width based on the corrected and updated count value in the heat accumulation counter in synchronization with the line sequential printing and controls the driving circuit based on the result of the calculating.

Thus, it is possible to print even on different types of thermal paper having different characteristics without deteriorating print quality.

In addition, according to the present invention, in the invention described above, the first correction coefficient is set to be a value smaller than one if heat accumulated in the line thermal head is less than a preset predetermined value due to the thermal conductivity characteristic of the thermal paper, and the first correction coefficient is set to be a value larger than one if the heat accumulated in the line thermal head is larger than the preset predetermined value.

Thus, it is possible to adjust the print quality in accordance with the thermal conductivity characteristic of the thermal paper.

In addition, according to the present invention, in the invention described above, the second correction coefficient is set to be a value smaller than one if heat radiation characteristic of the line thermal head is higher than a preset predetermined value due to the thermal conductivity characteristic of the thermal paper, and the second correction coefficient is set to be a value larger than one if the heat radiation characteristic is lower than the preset predetermined value.

Thus, it is possible to adjust the print quality in accordance with the thermal conductivity characteristic of the thermal paper.

DETAILED DESCRIPTION OF THE PREFERRED EMBODIMENT

Now, a thermal printer apparatus according to an embodiment of the present invention will be described with reference to the attached drawings.

Figure 1:
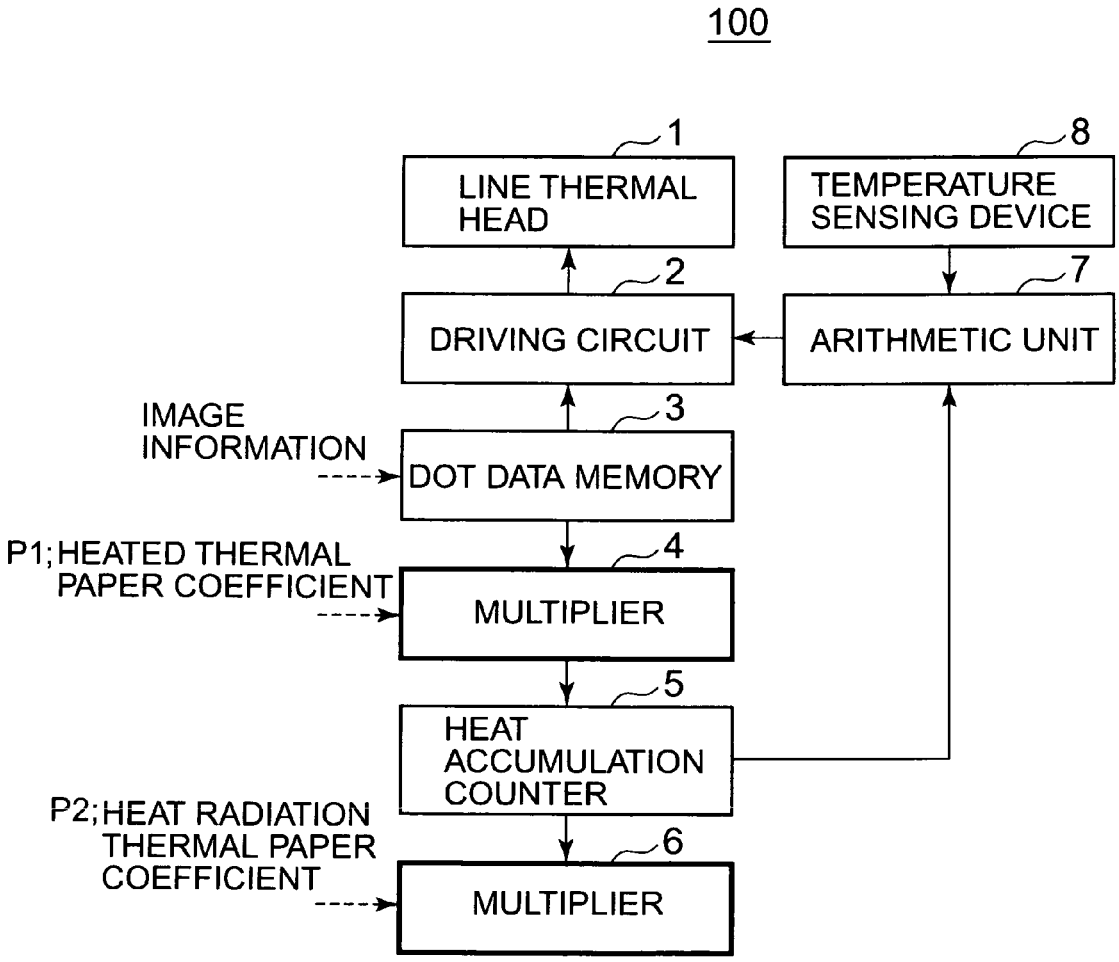
FIG. 1 is a schematic block diagram illustrating a thermal printer apparatus according to an embodiment of the present invention.

FIG. 1 is a schematic block diagram illustrating a thermal printer apparatus 100 according to the present embodiment.

The thermal printer apparatus 100 illustrated in this diagram includes a line thermal head 1, a driving circuit 2, a dot data memory 3, multipliers 4 and 6, a heat accumulation counter 5, an arithmetic unit 7, and a temperature sensing device 8.

The line thermal head 1 of the thermal printer apparatus 100 prints in accordance with line sequential method for each line in response to an energizing pulse corresponding to dot data. The dot data has information whether or not a dot is to be printed corresponding to a print position. The driving circuit 2 supplies an energizing pulse to the line thermal head 1 selectively corresponding to a dot to be printed in accordance with the dot data. The dot data memory 3 receives image information for printing and stores the received image information as dot data for each line in synchronization with line sequential printing. Then, the stored dot data is delivered to the driving circuit 2. The multiplier 4 counts the number of dots to be printed for each line, which is indicated by the dot data to be printed, and multiplies a result of the counting by a heated thermal paper coefficient P1 corresponding to thermal conductivity characteristic of thermal paper 42. The heat accumulation counter 5 counts results of the multiplying the number of dots to be printed for each line, which is indicated by the dot data to be printed, by the heated thermal paper coefficient P1 in an accumulative manner. The multiplier 6 multiplies a count value in the heat accumulation counter 5 by a heat radiation thermal paper coefficient P2 corresponding to the thermal conductivity characteristic of the thermal paper 42 and a heat radiation coefficient repeatedly at a predetermined period, so as to correct and update the count value of the heat accumulation counter 5. The arithmetic unit 7 calculates an energizing pulse width based on the corrected and updated count value of the heat accumulation counter 5 by the calculating result of the multiplier 6 in synchronization with the line sequential printing. Based on the energizing pulse width, the driving circuit 2 is controlled to set an energizing pulse width to be output to the line thermal head 1. The temperature sensing device 8 that is disposed in the line thermal head 1 senses temperature of the line thermal head 1 and converts the temperature into an electric signal to be output.

Note that the heated thermal paper coefficient P1 and the heat radiation thermal paper coefficient P2 that correspond to the thermal conductivity characteristic of the thermal paper 42 are set values that are set to be predetermined values. The heated thermal paper coefficient P1 and the heat radiation thermal paper coefficient P2 are stored in a storage area allocated in a storage portion disposed inside the thermal printer apparatus 100 so that a plurality of values are stored for each of them as a table. The values stored in the table can be read by using an indicator that identifies a type of the thermal paper 42 uniquely. Further, selecting means are provided for reading stored values by using the indicator, which are set as the values of the heated thermal paper coefficient P1 and the heat radiation thermal paper coefficient P2. The selecting means may be selection of a switch, insertion of a setting pin or the like, which is set in advance in accordance with a type of the thermal paper 42 that is used in the thermal printer apparatus 100.

The heated thermal paper coefficient P1 (first correction coefficient) is set to be one if heating characteristic of the line thermal head 1 is a standard characteristic. If heat can conduct to the line thermal head 1 so easily due to the thermal conductivity characteristic of the thermal paper 42 that accumulated heat in the line thermal head 1 becomes less than a preset predetermined value, the heated thermal paper coefficient P1 is set to be a value smaller than one. If heat hardly conducts to the thermal paper 42 so that accumulated heat in the line thermal head 1 becomes more than a preset predetermined value, the heated thermal paper coefficient P1 is set to be a value larger than one.

The preset predetermined value for the heated thermal paper coefficient P1 is determined as follows. The case where the heating characteristic of the line thermal head 1 is the standard characteristic is the case where the heating characteristic is in a range in which it can be regarded as the same as datum heating characteristic of the line thermal head 1 when the standard thermal paper 42 is used for printing. The value that determines the range is the predetermined value for determining the value of the heated thermal paper coefficient P1.

In addition, the heat radiation thermal paper coefficient P2 (second correction coefficient) is set to be one if heat radiation characteristic of the line thermal head 1 is a standard characteristic. If the heat radiation characteristic of the line thermal head 1 is higher than a preset predetermined value due to the thermal conductivity characteristic of the thermal paper 42, the heat radiation thermal paper coefficient P2 is set to be a value smaller than one. If the heat radiation characteristic is lower than the preset predetermined value, the heat radiation thermal paper coefficient P2 is set to be a value larger than one.

The preset predetermined value for the heat radiation thermal paper coefficient P2 is determined as follows. The case where the heat radiation characteristic of the line thermal head 1 is the standard characteristic is the case where the heat radiation characteristic is in a range in which it can be regarded as the same as datum heat radiation characteristic of the line thermal head 1 when the standard thermal paper 42 is used for printing. The value that determines the range is the predetermined value for determining the value of the heat radiation thermal paper coefficient P2.

Thus, it is possible to adjust print quality in accordance with the thermal conductivity characteristic of the thermal paper 42.

Figure 2:
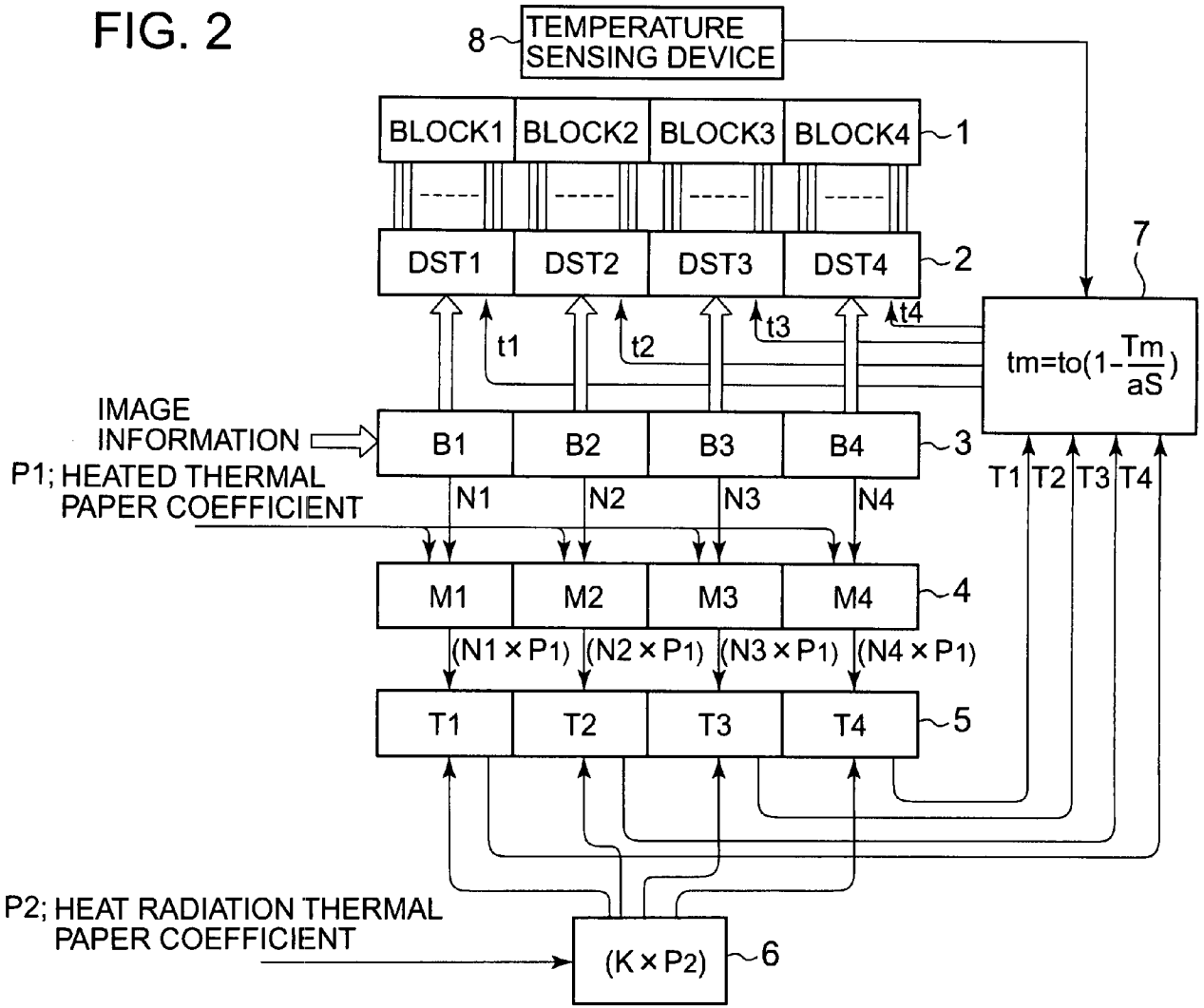
FIG. 2 is a block diagram illustrating a structure of the thermal printer apparatus according to the embodiment.

FIG. 2 is a block diagram illustrating a concrete structural example of the thermal printer apparatus.

In a thermal printer apparatus 100 illustrated in this diagram, the line thermal printer head 1 includes four blocks. Each of the blocks includes a predetermined number of heating elements arranged on a straight line. The driving circuit 2 includes four driving circuit units DTS1 to DTS4 corresponding to the four blocks of the line thermal head 1. The dot data memory 3 includes four dot data memory areas B1 to B4 corresponding to the driving circuit units, respectively.

The multiplier 4 includes four multiplication units M1 to M4 corresponding to four dot data memory areas B1 to B4. Here, the m-th multiplier Mm (m=1, 2, 3 and 4) respectively multiplies the number Nm of dots to be printed, which is indicated by dot data corresponding to the m-th dot data memory area Bm, by the heated thermal paper coefficient P1 that is set in advance for each line sequential printing and outputs a result of the multiplication.

The heat accumulation counter 5 includes heat accumulation counter units T1 to T4 corresponding to four multiplication units M1 to M4. Here, the m-th heat accumulation counter unit Tm (m=1, 2, 3 and 4) receives the result of the multiplication between the number Nm of dots to be printed, which is indicated by the dot data corresponding to the m-th dot data memory area Bm, and the heated thermal paper coefficient P1 for each line sequential printing and adds the same in an accumulative manner.

Each unit of the heat accumulation counter 5 is connected to the multiplier 6, and a heat radiation constant K is multiplied to the accumulative count value of each unit repeatedly at a predetermined period.

Each unit of the heat accumulation counter 5 is connected to the arithmetic unit 7, which receives a corrected and updated coefficient Tm (m=1, 2, 3 and 4) from each of the heat accumulation counter units T1 to T4 for each line sequential printing and calculates an energizing pulse width tm for each unit of the driving circuit in accordance with the relational expression indicated in Expression (1).

$$tm = t_0 \times \left(1 - \frac{Tm}{a \times s}\right) \tag{1}$$

In Expression (1), t0 denotes a predetermined datum energizing pulse width per dot that is determined for each line sequential printing, S denotes a saturation value of the corrected and updated coefficient that will be saturated to be a predetermined value in case of continuous printing, and "a" denotes a coefficient. The arithmetic unit 7 determines a value of the coefficient "a" sequentially based on temperature information of the line thermal head 1 that is output from the temperature sensor 8, and it determines a predetermined datum energizing pulse width is for each line sequential printing.

Each unit of the driving circuit 2 controls the energizing pulse width with reference to a datum energizing pulse width t0 derived by the arithmetic unit 7, so as to deliver a pulse having the energizing pulse width tm to the line thermal head 1. The temperature sensing device 8 is disposed at the line thermal head 1 so that temperature of the line thermal head 1 is sensed and converted into an electric signal to be output.

Temperature control of the line thermal head 1 will be described with reference to the drawings.

Figure 3:
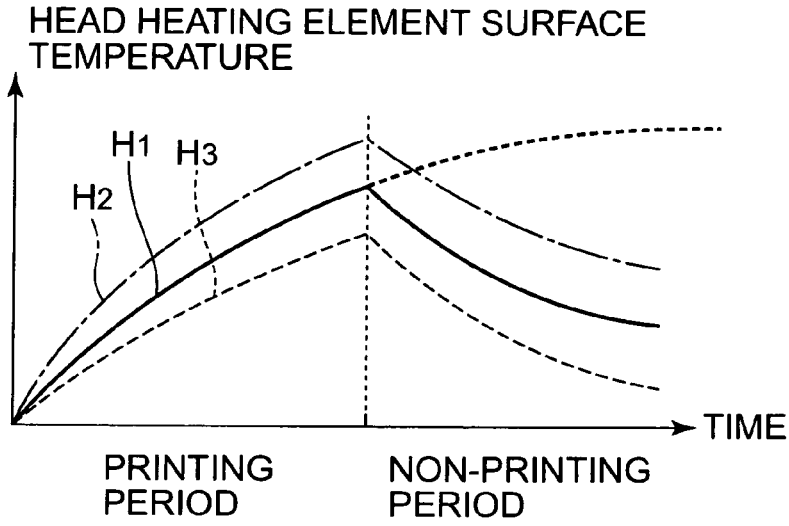
FIG. 3 is a waveform diagram illustrating a temperature change of a line thermal head in the embodiment.

FIG. 3 is a graph illustrating temperature change of the line thermal head 1.

As to the graph illustrated in this diagram, the horizontal axis represents a lapse of time, and the vertical axis represents temperature of the line thermal head 1. A first half of the time in this diagram indicates a period while the printing process is performed, and a second half indicates a period while the printing process is not performed.

A graph H1 indicates a temperature change of the line thermal head 1 in the case where the printing is performed on the thermal paper 42 having a standard heat accumulation characteristic and a standard heat radiation characteristic.

A graph H2 indicates a temperature change of the line thermal head 1 in the case where the printing is performed on the thermal paper 42 to which heat hardly conducts so that accumulated heat in the line thermal head 1 becomes more than a preset predetermined value. In other words, the graph H1 indicates the temperature change of the line thermal head 1 in the case where the printing is performed on the thermal paper 42 that makes heat applied to the line thermal head 1 be accumulated easily and makes the accumulated heat in the line thermal head 1 be hardly radiated. The graph H2 has a large gradient in a printing period and a small gradient in a non-printing period compared with the graph H1 indicating the temperature change in case of the thermal paper 42 having the standard thermal conductivity characteristic. If the printing is performed by applying to the line thermal head 1 the same amount of heat as the case where the printing is performed on the thermal paper 42 having the standard heating characteristic, temperature of the line thermal head 1 increases more rapidly than the case where the thermal paper 42 having the standard thermal conductivity characteristic is used. In addition, as to the accumulated heat in the line thermal head 1 in the non-printing period, a time constant of heat radiation becomes large compared with the case of the thermal paper 42 having the standard heat radiation characteristic, so temperature decreases slowly. In other words, a result of the printing becomes dark print.

A graph H3 indicates a temperature change of the line thermal head 1 in the case where the printing is performed on the thermal paper 42 to which heat easily conducts so that accumulated heat in the line thermal head 1 becomes less than a preset predetermined value. In other words, the graph H3 indicates the temperature change of the line thermal head 1 in the case where the printing is performed on the thermal paper 42 that makes heat applied to the line thermal head 1 be hardly accumulated and makes the accumulated heat in the line thermal head 1 be easily radiated. The graph H3 has a small gradient in a printing period and a large gradient in a non-printing period compared with the graph H1 indicating the temperature change in case of the thermal paper 42 having the standard thermal conductivity characteristic. If the printing is performed by applying to the line thermal head 1 the same amount of heat as the case where the printing is performed on the thermal paper 42 having the standard heating characteristic, temperature of the line thermal head 1 is less likely to increase than the case where the thermal paper 42 having the standard thermal conductivity characteristic is used. In addition, as to the accumulated heat in the line thermal head 1 in the non-printing period, a time constant of heat radiation becomes small compared with the case of the thermal paper 42 having the standard heat radiation characteristic, so temperature decreases rapidly. In other words, a result of the printing becomes light print.

Thus, it is shown that the temperature change characteristic of the line thermal head 1 changes when the thermal conductivity characteristic of the thermal paper 42 changes. A difference of the thermal conductivity characteristic of the thermal paper 42 is caused by, for example, a difference of a thickness or a material of base paper and an overcoat layer applied onto the surface of the same. In addition, since the heat accumulation characteristic and the heat radiation characteristic of the line thermal head 1 that are dependent on the thermal conductivity characteristic of the thermal paper 42 are characteristics independent of each other, they are different characteristics for the individual thermal paper 42. The temperature change of the line thermal head 1 is different in accordance with each combination of the heat accumulation characteristic and the heat radiation characteristic. Other than the heat accumulation characteristic and the heat radiation characteristic of the line thermal head 1 described above, the thermal paper 42 having different thermal conductivity characteristic may be used, so that the heat accumulation characteristic and the heat radiation characteristic indicating the temperature change of the line thermal head 1 are different.

Therefore, unless the amount of heat to be applied in the printing process is controlled in accordance with the thermal conductivity characteristic of the thermal paper 42, the temperature change of the line thermal head 1 cannot be controlled sufficiently for suppressing a variation occurring in print results.

Figure 4:
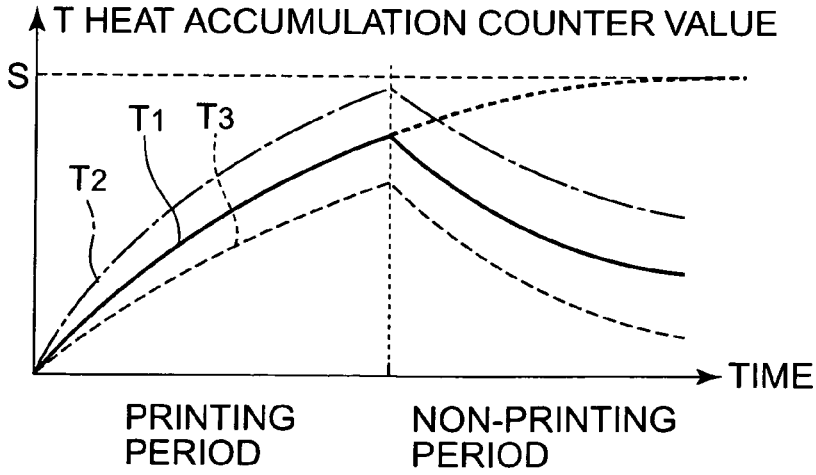
FIG. 4 is a waveform diagram illustrating a result of modeling the temperature change of the line thermal head in the embodiment.

FIG. 4 is a graph showing a result of modeling the temperature change of the line thermal head 1.

As to the graph illustrated in this diagram, the horizontal axis represents a lapse of time, and the vertical axis represents a value of the heat accumulation counter as an indicator of a modeled temperature change of the line thermal head 1. A first half of the time in this diagram indicates a period while the printing process is performed, and a second half indicates a period while the printing process is not performed.

A value of the heat accumulation counter shown in the graph T1 indicates a result of the calculation in the model case where the thermal paper 42 having the standard thermal conductivity characteristic is used for printing. As to a change in a value T(x) of the heat accumulation counter, characteristic in the printing period is shown in Expression (2).

$$T(x) = \frac{ts \times N}{tp \times 1nk}(K^{x/ts} - 1) \tag{2}$$

In Expression (2), N denotes the number of dots to be printed, and x denotes elapsed time. tp denotes a printing period, is denotes a heat radiation period, and K denotes a heat radiation constant.

In addition, a saturation value S to which the graph T1 becomes asymptotic when the printing operation is continued is indicated in Expression (3).

$$S = -\frac{ts \times N}{tp \times 1nk} \tag{3}$$

As shown in Expression (3), the saturation value S is proportional to the number of dots to be energized.

In addition, as to a value of the heat accumulation counter shown in the graph T1, characteristic in the heat radiation period is indicated in Expression (4).

$$T(x)=T' \times K^{x/ts} \tag{4}$$

In Expression (4), T' denotes a value of the heat accumulation counter when the printing operation is finished, that is an initial value indicating the heat radiation characteristic. Note that the "Patent Document 1" should be referred to for details of deriving Expressions (2) to (4).

When the printing is performed based on the standard value indicated in the graph T1, the thermal paper 42 is heated by the energy amount depending on the number N of dots to be energized as shown in the above-mentioned Expressions (2) and (4). Therefore, it is impossible to support the case where the heat accumulation characteristic and the heat radiation characteristic of the line thermal head 1 are different due to the difference of the thermal conductivity characteristic of the thermal paper 42 as illustrated in FIG. 3.

Here, Expression (5) defines a heat accumulation counter Ta(x) considering correction in accordance with the thermal conductivity characteristic of the thermal paper 42 by using the heated thermal paper coefficient P1 with respect to the characteristic in the printing period in the standard setting shown in Expression (2).

$$T(x) = \frac{ts \times N \times P1}{tp \times 1nk}(K^{x/ts} - 1) \tag{5}$$

Expression (5) can be regarded as an expression in which the heated thermal paper coefficient P1 is multiplied to the number N of dots to be energized shown in Expression (2).

In addition, Expression (6) defines a heat accumulation counter T(x) considering correction in accordance with the thermal conductivity characteristic of the thermal paper 42 by using the heat radiation thermal paper coefficient P2 with respect to the characteristic in the printing period in the standard setting shown in Expression (4).

$$T(x)=T'\times(K\times P2)^{x/ts} \quad (6)$$

Expression (6) can be regarded as an expression in which the heat radiation thermal paper coefficient P2 is multiplied to a heat radiation coefficient K in Expression (4).

The graph T1 indicates a value of the heat accumulation counter corresponding to the temperature change of the line thermal head 1 in the case where the printing is performed on the thermal paper 42 having a standard heat accumulation characteristic and a standard heat radiation characteristic. In contrast, a graph T2 indicates a value of the heat accumulation counter corresponding to the temperature change of the line thermal head 1 in the case where heat is easily conducted to the thermal paper 42 so that the accumulated heat in the line thermal head 1 decreases to be less than a preset predetermined value. A graph T3 indicates a value of the heat accumulation counter corresponding to the temperature change of the line thermal head 1 in the case where heat is hardly conducted to the thermal paper 42 so that the accumulated heat in the line thermal head 1 increases to be more than a preset predetermined value. According to the corrections shown in Expressions (5) and (6), it is possible to indicate a model that can also support the temperature change of the line thermal head 1 caused by a difference of the thermal conductivity characteristic of the thermal paper 42.

Figure 5:
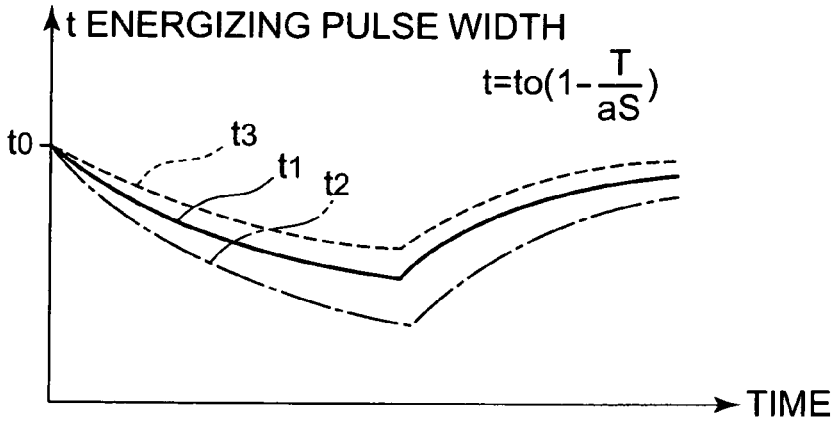
FIG. 5 is a waveform diagram illustrating an energizing pulse width of the line thermal head in the embodiment.

FIG. 5 is a graph showing the energizing pulse width of the line thermal head 1 that is calculated based on a value of the heat accumulation counter indicated in FIG. 4.

In the graph illustrated in this diagram, the horizontal axis represents a lapse of time, the vertical axis represents a value of the energizing pulse width t with respect to the line thermal head 1, and t0 denotes an initial value of a standard energizing pulse width to be a reference. A first half of the time in this diagram indicates a period while the printing process is performed, and a second half indicates a period while the printing process is not performed.

A value of the energizing pulse width shown in the graph t1 indicates the energizing pulse width in the model case where the thermal paper 42 having the standard thermal conductivity characteristic is used for printing. In addition, the graph t2 and the graph t3 indicate values of the energizing pulse width based on a value of the heat accumulation counter when the printing is performed on the thermal paper 42 that easily accumulates the applied heat and the thermal paper 42 that hardly accumulates the applied heat, respectively.

Comparing FIG. 3 with FIG. 5, the energizing pulse width is controlled to be decreased if the temperature of the line thermal head 1 is apt to increase. As the graph shown in FIG. 3 increases, the graph shown in FIG. 5 decreases.

With reference to the drawings, control procedure of the energizing pulse width of the line thermal head 1 will be described.

Figure 6:
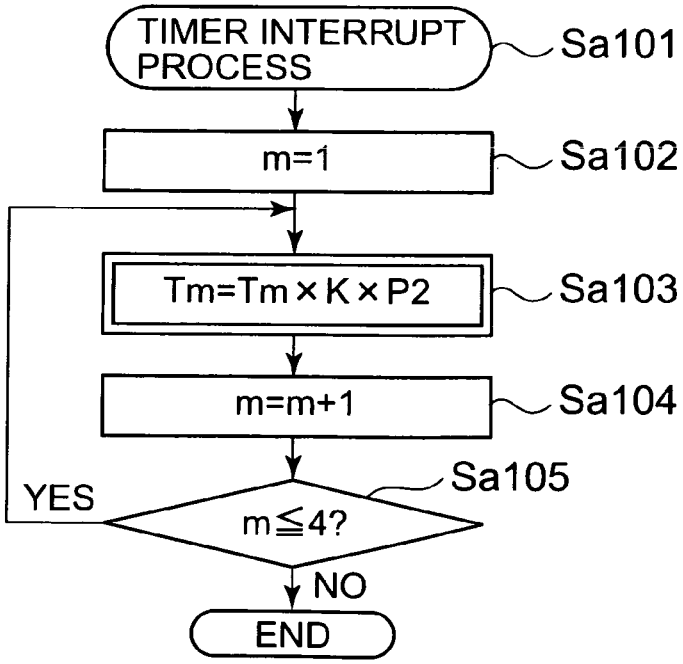
FIG. 6 is a flowchart (part 1) illustrating a procedure for controlling the energizing pulse width of the line thermal head in the embodiment.

FIG. 6 is a flowchart illustrating a procedure of a heat radiation process of the heat accumulation counter for controlling the heat radiation characteristic among procedures of processes for controlling the energizing pulse width of the line thermal head 1.

The process illustrated in the flowchart is an interrupt process that is activated by a timer interrupt process at a heat radiation period is defined to be predetermined time interval by a time keeping function of the thermal printer apparatus 100 (Step Sa101). When the timer interrupt process is activated, a value of a variable m indicating the number of blocks in the line thermal head 1 is set to be one and is stored in the storage area to which the variable m is allocated (Step Sa102).

In order to perform the calculating process based on the above-mentioned Expression (6) repeatedly, the corrected and updated coefficients Tm (m=1, 2, 3 and 4) are derived by the calculating process as shown in Expression (7).

$$Tm=Tm\times K\times P2 \quad (7)$$

The multiplier 6 multiplies the heat radiation coefficient K and the heat radiation thermal paper coefficient P2 to the corrected and updated coefficient Tm as shown in Expression (7), so as to update a value of the corrected and updated coefficient Tm and to store the same in the variable storage area of the corrected and updated coefficient Tm (Step Sa103). A value of the variable m for counting the number of blocks is incremented by one and is stored in the storage area for the variable m (Step Sa104). It is decided whether or not a value of the variable m is four or smaller. As a result of the decision, if it is decided that the value is four or smaller, the process is performed from Step Sa103 for deriving the corrected and updated coefficient Tm of the next block until the process is finished for every block. In addition, as a result of the decision, if it is decided that the value is larger than four, it means that the corrected and updated coefficient Tm has derived for every block, therefore, the heat radiation process of the heat accumulation counter for controlling the heat radiation characteristic is finished (Step Sa105).

Figure 7:
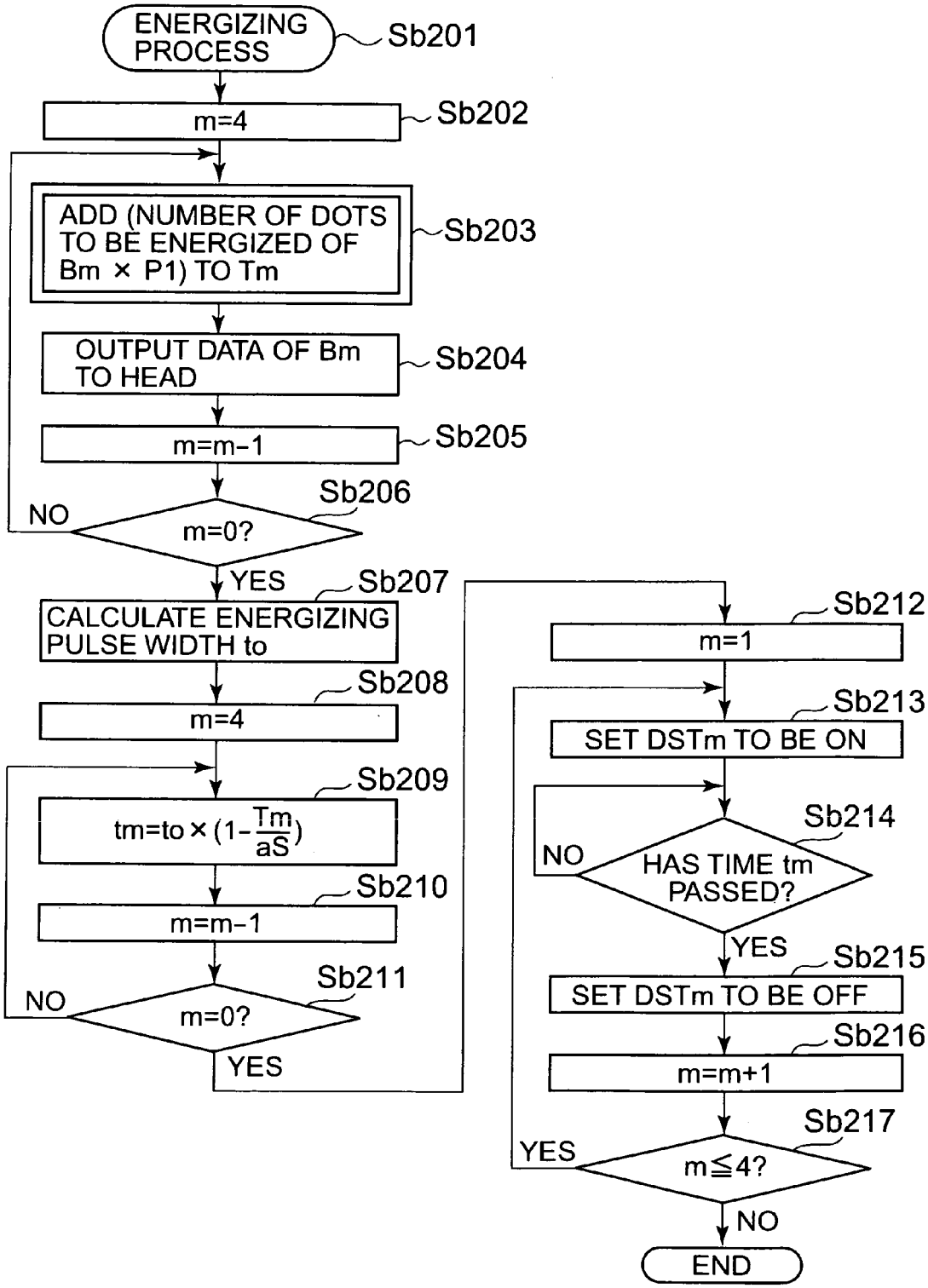
FIG. 7 is a flowchart (part 2) illustrating the procedure for controlling the energizing pulse width of the line thermal head in the embodiment.

FIG. 7 is a flowchart illustrating a procedure of a process in a heat accumulating period of the heat accumulation counter for controlling the heat accumulation characteristic on printing among procedures of processes for controlling the energizing pulse width of the line thermal head 1. The process illustrated in this flowchart is activated when a print request is sent to the thermal printer apparatus 100. If there is a dot to be printed in each line based on the print request, an energizing process is performed in which the line thermal head 1 is energized to print the dot data for each line (Step Sb201).

When the process is activated, a value of the variable m indicating the number of blocks of the line thermal head 1 is set to be four and is stored in the storage area to which the variable m is allocated (Step Sb202).

The multiplier 4 multiplies the number Nm of dots to be energized (m=1, 2, 3 and 4) in the dot data memory area Bm (m=1, 2, 3 and 4) and the heat radiation thermal paper coefficient P1 to the corrected and updated coefficient Tm (m=1, 2, 3 and 4). The heat accumulation counter 5 adds up results of the multiplication so as to update a value of the corrected and updated coefficient Tm and to store the same in the variable storage area of the corrected and updated coefficient Tm. It can be shown with Expression (8) (Step Sb203).

$$Tm=Tm+(Nm\times P1) \quad (8)$$

The dot data memory 3 outputs the data of Bm stored in the dot data memory 3 to the driving circuit 2 (Step Sb204). The dot data memory 3 subtracts one from a value of the variable m for counting the number of blocks and stores the same in the storage area for the variable m (Step Sb205). It is decided whether or not a value of the variable m is zero. As a result of the decision, if it is decided that the value is not zero, the process is performed from Step Sb203 for deriving the corrected and updated coefficient Tm of the next block until the process is finished for every block (Step Sb206). As a result of the decision in Step Sb206, if it is decided that the value of the variable m is zero, the arithmetic unit 7 calculates the datum energizing pulse width t0 (Step Sb207).

Next, a process for deriving the energizing pulse width is performed. A value of the variable m indicating the number of blocks of the line thermal head 1 is set to be four and is stored in the storage area to which the variable m is allocated (Step Sb208).

The arithmetic unit 7 derives the energizing pulse width tm (m=1, 2, 3 and 4) in accordance with Expression (1) and outputs the same to the driving circuit 2 (Step Sb209). The arithmetic unit 7 subtracts one from a value of the variable m for counting the number of blocks and stores the same in the storage area for the variable m (Step Sb210). It is decided whether or not a value of the variable m is zero. As a result of the decision, if it is decided that the value is not zero, the process is performed from Step Sb209 for deriving the energizing pulse width tm of the next block until the process is finished for every block (Step Sb211). As a result of the decision in Step Sb211, if it is decided that the value of the variable m is zero, the process for outputting the energizing pulse to the line thermal head 1 is performed. The driving circuit 2 sets a value of the variable m indicating the number of blocks of the line thermal head 1 to be one and stores the same in the storage area to which the variable m is allocated (Step Sb212).

The driving circuit 2 sets DSTm (m=1, 2, 3 and 4) to be "ON" state, so as to start energizing the line thermal head 1 (Step Sb213). After starting energizing DSTm, the driving circuit 2 decides whether or not a predetermined energizing pulse time tm has passed. As a result of the decision, the "ON" state of DSTm (m=1, 2, 3 and 4) is maintained from the start of energizing until the energizing pulse time tm passes (Step Sb214). As a result of the decision in Step Sb214, when the energizing pulse time tm has passed from the start of energizing by the driving circuit 2, DSTm (m=1, 2, 3 and 4) are set to be "OFF" state so that the energizing of the line thermal head 1 is stopped (Step Sb215).

In addition, a value of the variable m for counting the number of blocks is incremented by one and is stored in the storage area for the variable m (Step Sb216). It is decided whether or not a value of the variable m is four or smaller. As a result of the decision, if it is decided that the value is four or smaller, the process is performed from Step Sb213 for performing the energizing process of the next block until the process is finished for every block (Step Sb217). As a result of the decision in Step Sb217, if it is decided that the value of the variable m is more than four, the process for outputting the energizing pulse to the line thermal head 1 is finished.

As described above, the energizing pulse time is controlled in the thermal printer apparatus 100 for performing the printing process corresponding to the thermal conductivity characteristic of the thermal paper 42. Thus, the thermal printer apparatus 100 can perform the printing process even on different types of thermal paper 42 having different characteristics without deteriorating print quality. In addition, it is possible to adjust print quality in accordance with the heat accumulation characteristic and the heat radiation characteristic of the line thermal head 1 due to a difference of the thermal conductivity characteristic of the thermal paper 42.

Note that the present invention is not limited to the embodiments described above, which can be modified in the scope of the present invention without deviating from the spirit of the present invention. The number of blocks of the line thermal head 1 in the thermal printer apparatus 100 of the present invention, and the structure and the connection form of the thermal printer apparatus 100 are also not particularly limited.

Note that the line thermal head of the present invention is the line thermal head 1. In addition, the driving circuit of the present invention is the driving circuit 2. In addition, the dot data memory of the present invention is the dot data memory 3. In addition, the first multiplier of the present invention is the multiplier 4. In addition, the heat accumulation counter of the present invention is the heat accumulation counter 5. In addition, the second multiplier of the present invention is the multiplier 6. In addition, the arithmetic unit of the present invention is the arithmetic unit 7.

What is claimed is:

1. A thermal printer apparatus comprising:

a line thermal head for printing in a line sequential manner for each line in response to an energizing pulse corresponding to dot data containing information indicating whether or not there is a dot to be printed correspondingly to a print position;

a driving circuit for supplying the energizing pulse selectively to the line thermal head in accordance with the dot data;

a dot data memory for storing the dot data for each line in synchronization with line sequential printing and for delivering the dot data to the driving circuit;

a first multiplier for counting a number of dots to be printed for each line, which is indicated by the dot data, and for multiplying a result of the counting by a first correction coefficient corresponding to a thermal conductivity characteristic of thermal paper;

a heat accumulation counter for counting results of the multiplying the number of dots to be printed for each line, which is indicated by the dot data, by the first correction coefficient in an accumulative manner;

a second multiplier for multiplying a count value in the heat accumulation counter by a second correction coefficient corresponding to the thermal conductivity characteristic of the thermal paper and a heat radiation coefficient repeatedly at a predetermined period, so as to correct and update the count value; and an arithmetic unit for calculating an energizing pulse width based on the corrected and updated count value in the heat accumulation counter in synchronization with the line sequential printing and for controlling the driving circuit based on a result of the calculating.

2. A thermal printer apparatus according to claim 1, wherein the first correction coefficient is set to be a value smaller than one if heat accumulated in the line thermal head is less than a preset predetermined value due to the thermal conductivity characteristic of the thermal paper, and the first correction coefficient is set to be a value larger than one if the heat accumulated in the line thermal head is more than the preset predetermined value.

3. A thermal printer apparatus according to claim 1, wherein the second correction coefficient is set to be a value smaller than one if a heat radiation characteristic of the line thermal head is higher than a preset predetermined value due to the thermal conductivity characteristic of the thermal paper, and the second correction coefficient is set to be a value larger than one if the heat radiation characteristic is lower than the preset predetermined value.

4. A thermal printer apparatus according to claim 2, wherein the second correction coefficient is set to be a value smaller than one if a heat radiation characteristic of the line thermal head is higher than a preset predetermined value due to the thermal conductivity characteristic of the thermal paper, and the second correction coefficient is set to be a value larger than one if the heat radiation characteristic is lower than the preset predetermined value.

5. A printing method for a thermal printer apparatus, the method comprising the steps of:

printing by a line thermal head in a line sequential manner for each line in response to an energizing pulse corresponding to dot data containing information indicating whether or not there is a dot to be printed correspondingly to a print position;

supplying the energizing pulse selectively to the line thermal head in accordance with the dot data by a driving circuit;

storing the dot data for each line in synchronization with line sequential printing and delivering the dot data to the driving circuit by a dot data memory;

counting a number of dots to be printed for each line, which is indicated by the dot data, and multiplying a result of the counting by a first correction coefficient corresponding to a thermal conductivity characteristic of thermal paper by a first multiplier;

counting results of the multiplying the number of dots to be printed for each line, which is indicated by the dot data, by the first correction coefficient in an accumulative manner by a heat accumulation counter;

multiplying a count value in the heat accumulation counter by a second correction coefficient corresponding to the thermal conductivity characteristic of the thermal paper and a heat radiation coefficient repeatedly at a predetermined period, so as to correct and update the count value, by a second multiplier; and calculating an energizing pulse width based on the corrected and updated count value in the heat accumulation counter in synchronization with the line sequential printing and controlling the driving circuit based on a result of the calculating by an arithmetic unit.

* * * * *